US011711641B2

(12) United States Patent
Yochem et al.

(10) Patent No.: US 11,711,641 B2
(45) Date of Patent: Jul. 25, 2023

(54) RF IMMUNE MICROPHONE

(71) Applicant: Knowles Electronics, LLC, Itasca, IL (US)

(72) Inventors: Donald Yochem, Buffalo Grove, IL (US); Meiling Huang, Suzhou (CN)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 7 days.

(21) Appl. No.: 17/602,015

(22) PCT Filed: Apr. 10, 2019

(86) PCT No.: PCT/CN2019/082010
§ 371 (c)(1),
(2) Date: Oct. 7, 2021

(87) PCT Pub. No.: WO2020/206628
PCT Pub. Date: Oct. 15, 2020

(65) Prior Publication Data

US 2022/0159360 A1 May 19, 2022

(51) Int. Cl.
*H04R 1/08* (2006.01)
*H04R 7/16* (2006.01)

(52) U.S. Cl.
CPC ..... *H04R 1/08* (2013.01); *H04R 7/16* (2013.01)

(58) Field of Classification Search
CPC ..... H04R 1/08; H04R 7/16; H04R 2201/003; H04R 2225/49; H04R 2499/11; H04R 19/04
See application file for complete search history.

(56) References Cited

U.S. PATENT DOCUMENTS

| | | | | |
|---|---|---|---|---|
| 2006/0140423 | A1 | 6/2006 | Tanabe et al. | |
| 2009/0218668 | A1 | 9/2009 | Zhe et al. | |
| 2016/0261941 | A1 | 9/2016 | Brioschi et al. | |
| 2019/0313172 | A1* | 10/2019 | Sunshine | H04R 5/02 |
| 2022/0034740 | A1* | 2/2022 | Hsieh | G01L 9/0041 |

FOREIGN PATENT DOCUMENTS

| | | | |
|---|---|---|---|
| CN | 206993342 U | | 2/2018 |
| CN | 208540100 U | | 2/2019 |
| CN | 109565636 | * | 4/2021 |
| WO | 2018152003 A1 | | 8/2018 |

OTHER PUBLICATIONS

International Search Report, PCT/CN2019/082010/, Date of the actual completion of the International search Dec. 6, 2019, dated Jan. 8, 2020.
PCT Written Opinion of the International Searching Authority, PCT/CN2019/082010, International filing date Apr. 10, 2019, Date of mailing Jan. 8, 2020.

* cited by examiner

*Primary Examiner* — Tuan D Nguyen
(74) *Attorney, Agent, or Firm* — Flener IP & Business Law; Zareefa B. Flener

(57) ABSTRACT

The present disclosure relates to microphone devices. One microphone assembly includes a transducer and a housing. The microphone assembly includes an integrated circuit coupled to the transducer. The housing includes a port, a base, and a cover. The cover includes an inner wall and an outer wall. The inner wall and outer wall can be coupled to the base. The inner wall and the base are mechanically coupled and define an enclosed volume. The transducer is disposed in the enclosed volume.

20 Claims, 4 Drawing Sheets

RF IMMUNE MICROPHONE

BACKGROUND

Microphones are deployed in various types of electronic devices such as cellular phones, mobile devices, headsets, hands free systems, smart televisions, smart speakers, portable computers, etc. A microphone converts sound waves, via a transducer, into an electrical signal that represents the sound. Often, a cover over the transducer will experience undesirable thermo-acoustic effects (e.g., mechanical vibrations or heating) due to external electromagnetic radiation and other external sources. These uncontrolled thermo-acoustic effects can cause an air pocket under the cover, and over the transducer, to expand and/or vibrate, which may cause undesirable audio effects.

SUMMARY

Various embodiments disclosed herein are related to a microphone assembly. In some embodiments, the microphone assembly includes a transducer and a housing. In some embodiments, the microphone assembly includes an integrated circuit coupled to the transducer. The housing includes a port, a base, and a cover. The cover includes an inner wall and an outer wall. In an embodiment, the inner wall and outer wall are coupled to the base. The inner wall and the base are mechanically coupled and define an enclosed volume. The transducer is disposed in the enclosed volume.

The outer wall and inner wall are spaced apart from each other and define a gap (e.g., volume of air) therebetween. In an embodiment, the outer wall surrounds the inner wall completely. In some embodiments, the outer wall includes an opening (e.g., vent) that provides fluid communication between an external environment of the housing and the volume between the inner and outer walls (e.g., the gap). The opening may be sized to vent frequencies up to a fundamental frequency of a radio frequency interference pulse rate. The opening may be sized to vent frequencies up to 217 hertz (Hz). In some embodiments, the opening may be sized to vent any operational cellular or RF interface standards. That is, the opening may be sized to different dimensions depending upon specific applications.

The outer wall may be made out of a metal. The inner wall may be made out of a plastic or ceramic material. In an embodiment, both the inner and outer walls are made out of the same material. The inner and outer walls may include a cylindrical wall portion and a cap portion. The diameter of the cylindrical wall portion of the inner house has a diameter that is less than a diameter of the cylindrical wall portion of the outer wall. The outer wall extends a distance away from the base that is greater than a distance that the inner wall extends away from the base.

In some embodiments, the integrated circuit comprises one of an ASIC or a FPGA. The transducer is disposed within the enclosed volume over the port. The transducer may include a transducer substrate defining an aperture, a diaphragm coupled to the transducer substrate and disposed over the aperture, and a perforated back plate coupled to the transducer substrate and spaced apart from the diaphragm.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
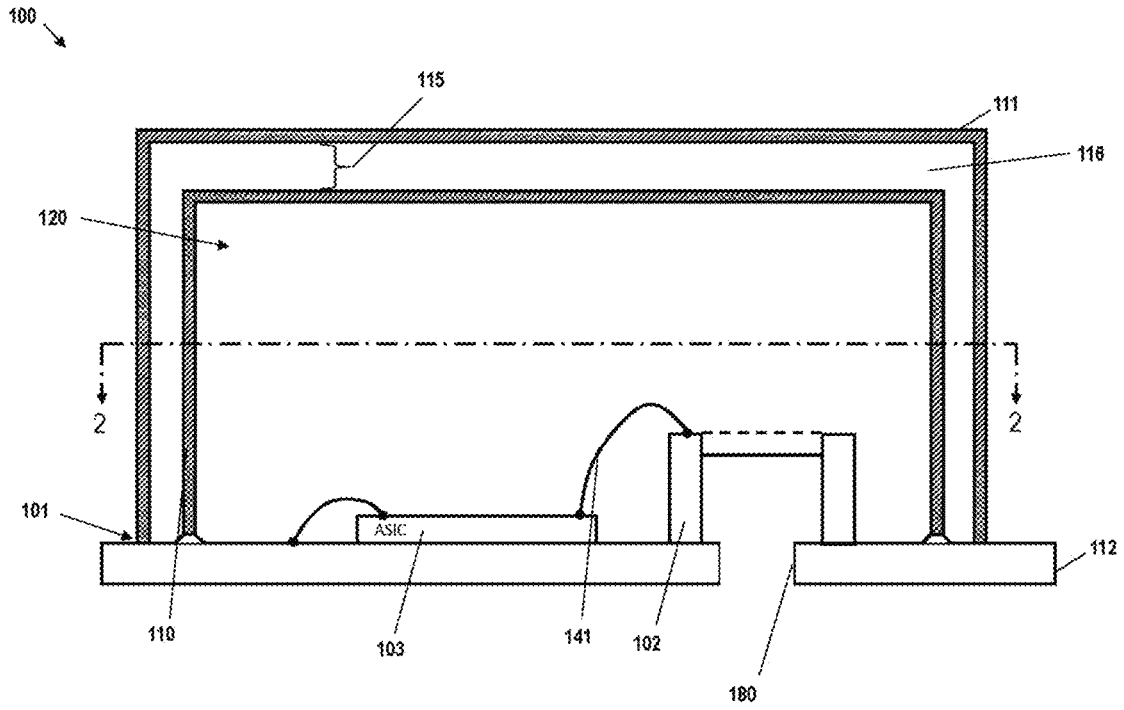
FIG. 1 is a side cross-sectional view of a microphone assembly in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The present disclosure describes devices and methods for improving the acoustic isolation of microphone assemblies. In particular, devices and methods are described for improving the radio frequency (RF) immunity of covers (e.g., cans) in microphone devices, such as metal covers, in order to reduce thermo-acoustic effects. A transducer of a microphone assembly converts a sound (e.g., pressure waves) into an electrical audio signal, and outputs the electrical audio signal to an integrated circuit. Because sound is pressure dependent, heat fluctuation and mechanical vibrations inevitably effect the sound. In some implementations of the present disclosure, the microphone assembly may include two covers, or a double-walled single cover, over the transducer in order to insulate the air around the transducer and thereby reduce the thermo-acoustic effects. In some embodiments, a microphone assembly may include additional electrically insulated materials than described herein.

In one or more embodiments, a housing of a microphone assembly is disclosed. In one or more embodiments, the microphone assembly includes a transducer, an integrated circuit (IC), and a housing. The housing may partially enclose the transducer and the integrated circuit. The transducer may convert a sound into a raw audio signal electrically representing the sound and provide the raw audio signal to the IC. The IC may process (e.g., amplify, filter, etc.) the audio signal and output an output signal (e.g., digital signal) representative of the sensed acoustic activity. The housing protects and isolates the transducer and the IC from the effects of RF signals on the performance of the microphone. In some embodiments, the IC may output the processed audio signal to an external electrical device.

The housing includes a cover and a base. The housing may also include a port. The cover may include an outer wall (e.g., a first cover) and an inner wall (e.g., a second cover). The inner wall and the outer wall may be mechanically connected to the base and spaced a distance apart. The distance apart provides an air-insulated buffer (i.e., a gap or volume) between the outer wall and the inner wall. The insulated buffer ensures that the inner wall is less effected by external heat sources (e.g., RF electromagnetic waves) that effect the outer wall. Thus, since the inner wall is less effected by any heating, undesirable thermo-acoustic effects that are typically inherent to microphones are significantly reduced. Thus, the two walls and the air-insulated buffer (i.e., gap) provide the microphone assembly with thermal and acoustic isolation, which, in turn, enhances the quality, reliance, and reliability of the microphone assembly.

Referring to FIG. 1, illustrated is a side cross-sectional view of a microphone assembly 100 according to an embodiment of the present disclosure. The microphone assembly 100 may be implemented in a cellular phone, mobile device, headset, hearing aid device, smart televisions, smart speakers, or any other type of host device. The microphone assembly 100 includes a housing 101 and a transducer 102. In an embodiment, the microphone assembly 100 also includes an integrated circuit (IC) 103 that is disposed within the housing 101. The transducer 102 and the IC 103 may be embodied as hardware components that are electrically coupled to each other through conductive wires or traces. In some embodiments, the microphone assembly 100 includes more, fewer, or different components than shown in FIG. 1.

The housing 101 includes an inner wall 110 (e.g., inner cover), an outer wall 111 (e.g., outer cover), and a base 112 (e.g., a substrate, such as a printed circuit board (PCB)). The inner wall 110 and the outer wall 111 are spaced a distance 115 apart. The distance 115 defines a gap 116 (i.e., a volume of air) between the outer wall 111 and the inner wall 110. The gap 116 may be filled with air. In some embodiments, other gasses may fill the gap 116. In some embodiments, the gap 116 may be a partial vacuum. The gap 116 may be a completely enclosed (and isolated) space. In an embodiment, the gap 116 has a consistent distance, distance 115, for the entire area between the inner wall 110 and the outer wall 111. In alternative embodiments, the gap 116 may be any size or shape. That is, the outer wall 110 may be disposed in any manner relative to the inner wall 111 and the base 112 such that a gap 116 is created therebetween.

The inner wall 110 is mechanically attached to the base 112 and defines an enclosed volume 120. In an embodiment, the outer wall 111 is also mechanically attached to the base 112 the distance 115 away from where the inner wall 110 is attached to the base 112. The inner wall 111 and outer wall 112 may be mechanically connected to a top surface of the base 112. In alternative embodiments, the outer wall 112 may be mechanically connected to side surfaces of the base 112 and the inner wall 112 may be mechanically connected to the top surface of the base 112. Two or more components may be mechanically connected via a solder, adhesive, molding, weld, latching device, or any other known techniques.

The housing 101 also includes a port 180. In an embodiment, the port 180 may be formed in the base 110. The transducer 102 is located over the port 180 and allows for the transducer 102 to sense a difference in pressure from the outside of the housing 101 and the enclosed volume 120. The difference in pressure allows the transducer to convert sound waves (e.g., pressure waves) into an electronic signal. In some embodiments, the transducer is mechanically connected to the base 112 over the port 180. In some implementations, the transducer 102 may be a microelectromechanical systems (MEMS) transducer. The gap 116 provides an insulative layer between the inner wall 110 and the outer wall 112 that helps prevent heating (e.g., due to RF waves impinging on the outer wall 111) of the outer wall 112 from being transferred to enclosed volume 120. The insulation of the enclosed volume 120 from heating helps prevent the sound waves (e.g., pressure waves) from being distorted due to heating (e.g., expanding) of the air in the enclosed volume 120. In some embodiments, the inner wall 110 and the outer wall 111 are formed of the same material. In some embodiments, the inner wall 110 and the outer wall 111 may be formed of different materials. For example, the inner wall 110 and the outer wall 111 may be made of stainless steel, aluminum, ceramic materials, plastic materials, or any other metal or metal alloy. In some embodiments, the outer wall 111 may be a metal that is mechanically and/or electrically connected to the base 112. In some embodiments, the inner wall 110 may be a plastic or ceramic material that is mechanically connected to the base 112.

The IC 103 is disposed within the enclosed volume 120. The IC 103 may be mechanically attached to the base 112 within the enclosed volume 120. The IC 103 is electrically and mechanically connected to an output of the transducer 102. In some embodiments, the IC 103 is electrically and mechanically connected to the transducer 102 via a wired connection 141. The IC 103 may be an application specific integrated circuit (ASIC), in some embodiments. The IC 103 may also be connected to another processor (not depicted) or other electronic component, such as a digital signal processor (DSP). In some embodiments, a DSP or other circuitry may also be disposed within the enclosed volume 120.

Figure 2:
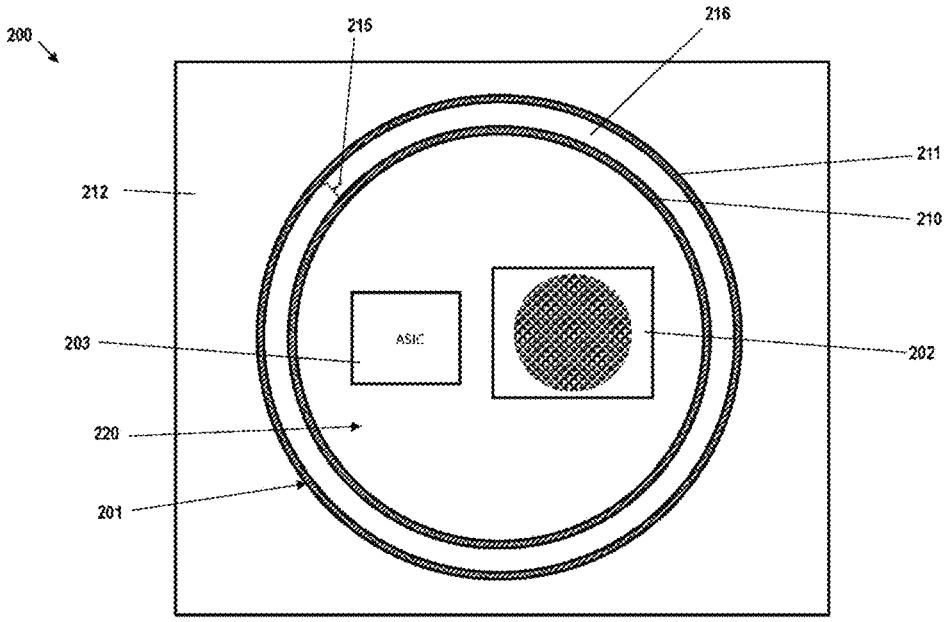
FIG. 2 is a top cross-sectional view of a microphone assembly in accordance with an illustrative embodiment.

Referring to FIG. 2, illustrated is a top cross-sectional view of a microphone assembly 200 according to embodiments of the present disclosure. The microphone assembly 200 includes a housing 201, a transducer 202, and an integrated circuit (IC) 203. The housing 201 includes an inner wall 210 (e.g., inner cover), an outer wall 211 (e.g., outer cover), a base 212. The inner wall 210 and the outer wall are separated by a distance 215. The distance 215 defines a gap 215 (e.g., a volume) between the inner wall 210 and the outer wall 211. The gap 215 may have a consistent distance 215 between the inner wall 210 and the outer wall 211 throughout the entire gap 215. The inner wall 210 and the outer wall 211 are mechanically connected to the base 212. The inner wall 210 and outer wall 211 may be continuously mechanically connected to the base 212 as the inner wall 210 and outer wall 211 extend on the base 212. That is, the inner wall 210 and the outer wall 211 may be sealed to the base 212 to create an enclosed volume 220 and the gap 216. The inner wall 210 and the outer wall 211 extend circularly on the base 212. In alternative embodiments, the inner wall 210 and the outer wall 211 may extend on the base 212 to create a square, polygon, octagon, or any different shapes. The transducer 202 and the IC 203 may be disposed within the enclosed volume 220. The transducer 202 and the IC 203 are mechanically connected to base 212 inside of the enclosed volume 220.

Figure 3:
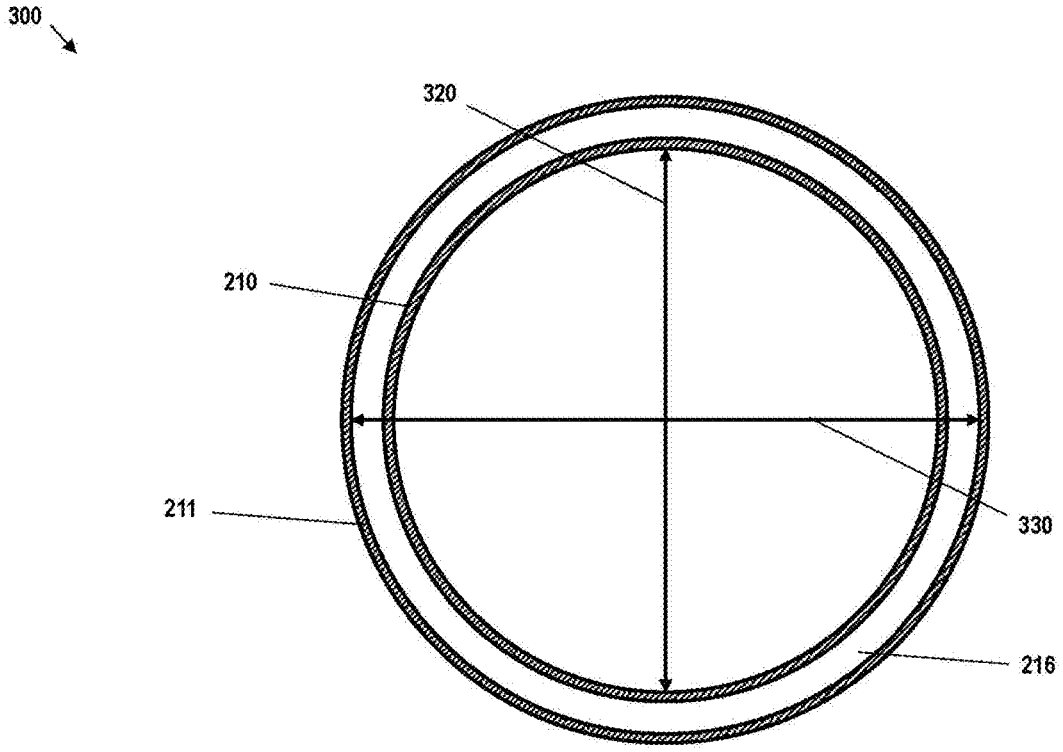
FIG. 3 is a top cross-sectional view of a microphone assembly in accordance with an illustrative embodiment.

Referring to FIG. 3, illustrated is a top cross-sectional view 300 of the inner wall 210 and outer wall 211 from FIG. 2 according to embodiments of the present disclosure. The inner wall 210 extends in a circle with a first diameter 320.

The outer wall 211 extends in a circle with a second diameter 330. That is, in an embodiment, the inner wall 210 and the outer wall 211 have a cylindrical shape with a top (not depicted) on the cylinder. The difference between the first diameter 320 and the second diameter 321 define the gap 216. In an embodiment, the circle created by the inner wall 210 and the circle created by the outer wall 220 are concentric. The difference between the second diameter 321 and the first diameter 321 is roughly equal (e.g., equal except for a width of the inner wall 210) to twice the distance 215 that defines the gap 216. In an embodiment, the inner wall 210 and the outer wall 211 are made out of the same material.

Figure 4:
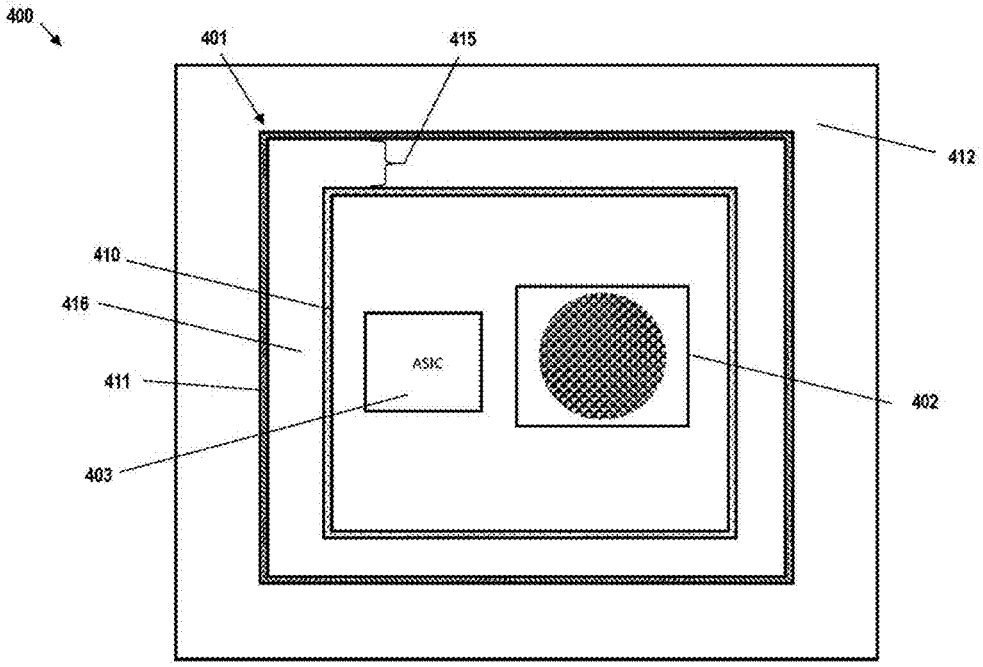
FIG. 4 is a top cross-sectional view of a microphone assembly in accordance with an illustrative embodiment.

Referring to FIG. 4, illustrated is a top cross-sectional view of a microphone assembly 400 according to embodiments of the present disclosure. The microphone assembly 400 includes a housing 401, a transducer 402, and an integrated circuit (IC) 403. The housing 401 includes an inner wall 410, an outer wall 411, and a base 412. The inner wall 410 and the outer wall 411 extend along the base 412 in the shape of a square. In alternative embodiments the inner and outer walls 410 and 411 may extend along the base in different shapes. The inner wall 410 are separated by a distance 415 on the sides. The area between the inner wall 410 and the outer wall 411 define a gap 416 (volume of air). In alternative embodiments, each side of the inner wall 410 and the outer wall 411 are separated by different distances. The inner wall 410 and base 412 define an enclosed volume 420. In an embodiment, the enclosed volume 420 is an air pocket that is isolated from the outside of the housing. The transducer 402 and the IC 103 are disposed on the base 412 within the enclosed volume 420. In an embodiment, the inner wall 410 includes a top (not depicted) and the outer wall 420 also includes a top (not depicted). The top (not depicted) of the inner wall 410 and the top (not depicted) of the outer wall 411 are also separated (e.g., by the distance 415 or any distance) and the separation is fluidly connected to gap 416.

Figure 5:
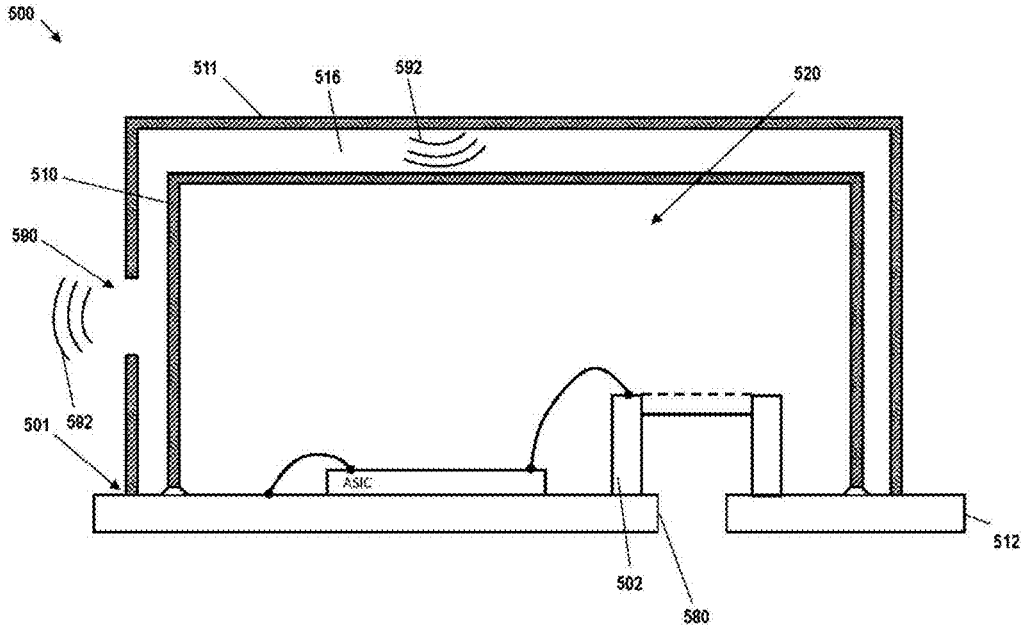
FIG. 5 is a side cross-sectional view of a microphone assembly in accordance with an illustrative embodiment.

Referring to FIG. 5, illustrated is a top cross-sectional view of a microphone assembly 500 according to embodiments of the present disclosure. In general, FIG. 5 is similar to FIG. 1 in that the microphone assembly 500 includes a housing 501 and a transducer 502. Additionally, the housing 501 includes an inner wall 510, an outer wall 511, a base 512, and a port 580. The inner wall 510 and base 512 define an enclosed volume 520. The enclosed volume 520 is a volume of air that is isolated from the outside of the housing 501. The inner wall 510 and the outer wall 511 are similarly separated from each other. The separation from the inner wall 510 and outer wall 511 defines a gap 516 (e.g., volume of air). In an embodiment, the outer wall 511 includes a vent 590. The vent 590 allows for any heat 592 and any corresponding acoustic signals (e.g., pressure waves caused by heating of the air) in the gap 516 to escape. Thus, the vent 590 may improve the efficiency by ensuring that a consistent pressure and temperature in the gap 516 is maintained. The vent 590 may be large enough to allow for sufficient venting, but small enough to reduce the amount of electromagnetic waves that can impinge upon the inner wall 510 (e.g., and thereby cause heating in the inner wall 510). In some embodiments, the maximum diameter of the vent 590 is one-tenth of a wavelength of an expected radio-frequency (RF) interference signal. Further, the vent 590 may also help with the manufacturing of the microphone assembly 500 by allowing for venting during the reflow process.

In an embodiment, the vent 590 may be a circle. In alternative embodiments, the vent 590 may be any shape. For example, the vent may be a square, octagon, or any other polygon. In an embodiment, the vent 590 is located on a side of the outer wall 511. Further, the vent 590 may be placed on any side or top of the outer wall 511. In some embodiments, the placement of the vent 590 will be application specific based on a determination of a relative direction of where a majority of the problematic electromagnetic waves are coming from. In yet alternative embodiments, the vent may be located on the base 512 in between the inner wall 510 and the outer wall 511.

Figure 6:
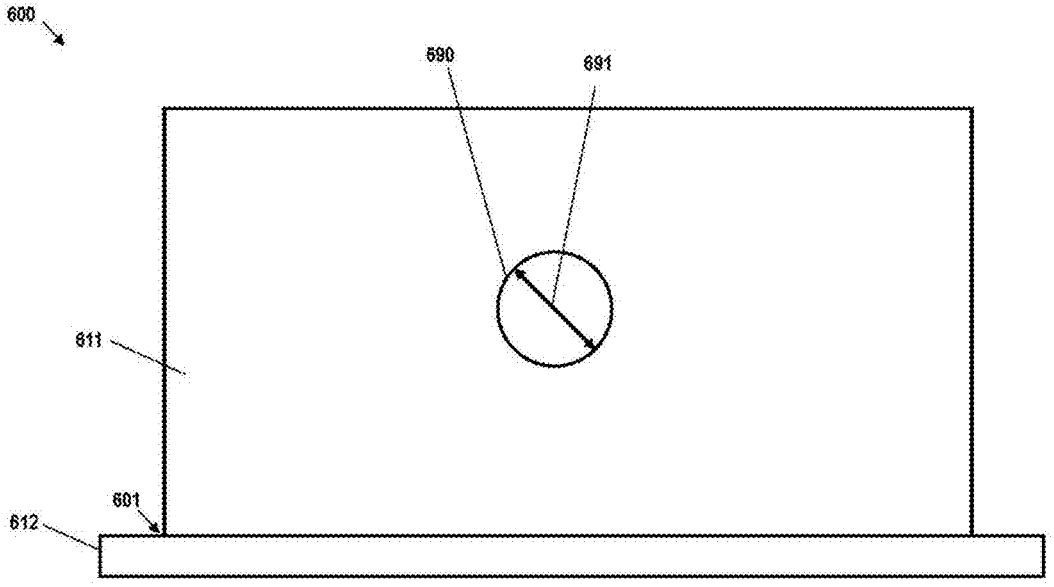
FIG. 6 is a side view of a microphone assembly in accordance with an illustrative embodiment.

FIG. 6 depicts a side view of a microphone assembly 600 in accordance with an illustrative embodiment. The microphone assembly 600 includes a housing 601. The housing 601 includes an inner wall (not depicted), an outer wall 611, and a base 612. The outer wall 611 is mechanically attached to the base 612 such that there is a seal therebetween. The outer wall 611 includes a vent 690. The vent 690 is circular shaped and has a diameter 691. The vent 690 allows for air to flow in and out of a gap (not depicted) between the inner wall (not depicted) and the outer wall 611. In alternative embodiments, the vent 690 is a different shape. The vent 690 (e.g., and diameter 691) is sized such that the vent 690 can vent frequencies up to at least a fundamental frequency of a radio frequency interference pulse rate. In an embodiment, the vent 690 is sized to vent frequencies up to at least 217 hertz (Hz). In another embodiment, the vent 690 is sized to vent frequencies up to two harmonics of the fundamental frequency of a determined radio frequency interference pulse rate.

Figure 7:
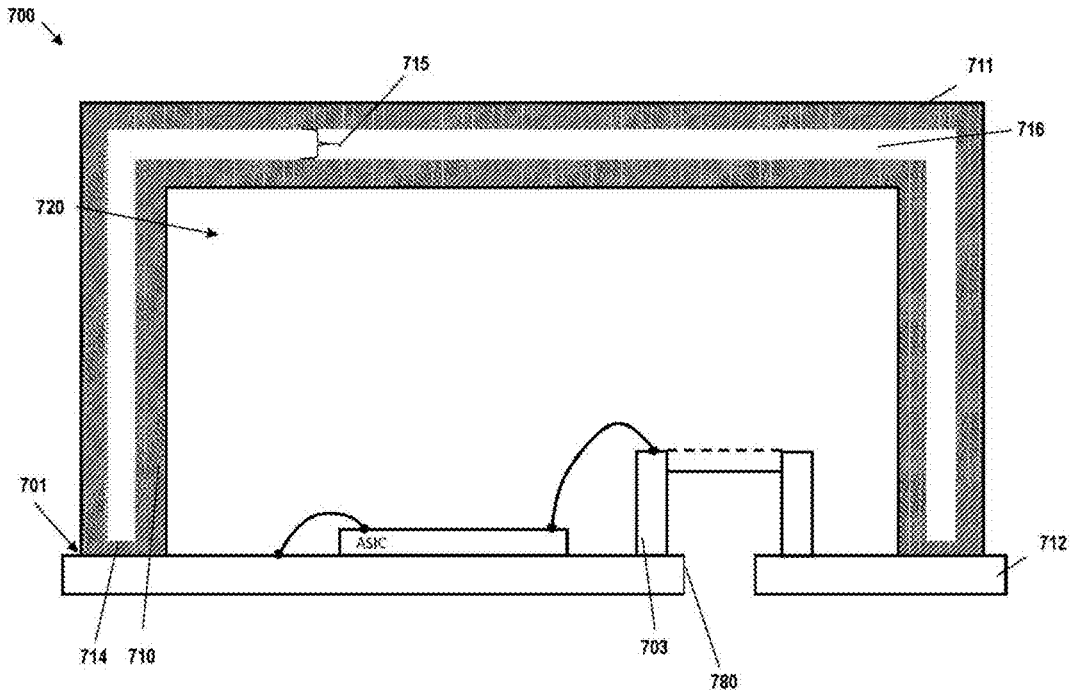
FIG. 7 is a side cross-sectional view of a microphone assembly in accordance with an illustrative embodiment.

Referring to FIG. 7, illustrated is a side cross-sectional view of a microphone assembly 700 according to an embodiment of the present disclosure. The microphone assembly 700 includes a housing 701 and a transducer 703. In an embodiment, the microphone assembly 700 also includes an integrated circuit (IC) (not depicted) disposed within the housing 701. The housing 701, may include a single cover 714, a defined port 780, and a base 712. The single cover 714 includes an inner wall 710 and an outer wall 711. In an embodiment, the inner wall 710 and the outer wall 711 may be two different covers that are formed as one unit (i.e., a single cover 714). The inner wall 710 and the outer wall 711 may be welded or attached together via any known mechanism that allows for the inner and outer walls 710 and 711 to form a single cover 714. The single cover 714 may then be affixed, adhered, or otherwise mechanically connected to the base. The inner wall 710 and the outer wall 711 are spaced a distance 715 apart except for where they are attached to form the single cover 714. The single cover 714 is mechanically attached to the base 712 and defines an enclosed volume 720 between the inner wall 710 and the base 712.

The distance 715 defines a gap 716 (i.e., a volume of air) between the outer wall 711 and the inner wall 710. In an embodiment, the gap 716 may be a completely enclosed (and isolated) space. In an alternative embodiment, the outer wall 711 may include a vent (not depicted) to allow air in and out of the gap. In some embodiments, the gap 716 has a consistent distance, distance 715, for the entire area between the inner wall 710 and the outer wall 711 except where the inner wall 710 and outer wall 711 are attached to form the single cover 714. In alternative embodiments, the gap 716 may be any size or shape. That is, in alternative embodiments, the outer wall 710 may be disposed in any manner relative to the inner wall 711 and the base 712 such that a gap 716 is created therebetween. In alternative embodiments, the position of where the inner and outer walls 710 and 711 are mechanically connected or attached to form the single cover 714 may be different. That is, the inner and outer walls 710 and 711 may be mechanically connected to form the single cover 714 near the base 714, on the top, there may be structural struts between the inner and outer walls 710 and 711, etc.

Figure 8:
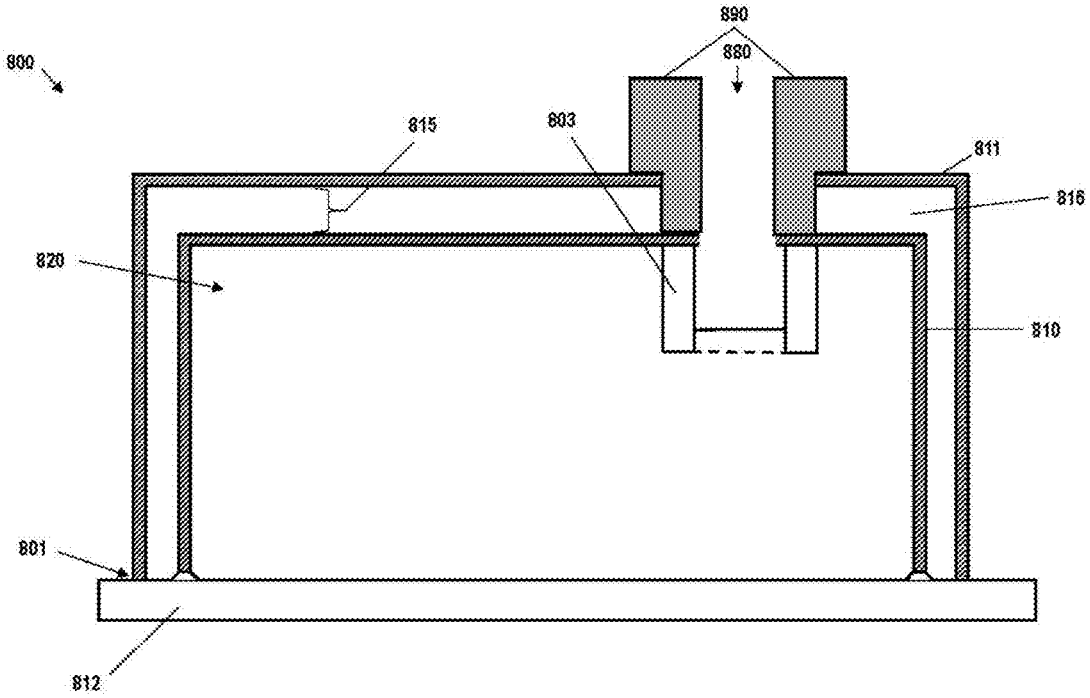
FIG. 8 is a side cross-sectional view of a microphone assembly in accordance with an illustrative embodiment.

Referring to FIG. 8, illustrated is a side cross-sectional view of a microphone assembly 800 according to an embodiment of the present disclosure. The microphone assembly 800 includes a housing 801 and a transducer 803. In an embodiment, the microphone assembly 800 also includes an integrated circuit (IC) (not depicted) disposed within the housing 801. The housing 801 includes an inner wall 810, an outer wall 811, and a base 812. In an embodiment, the inner wall 810 and the outer wall 811 may be two different covers that are formed as one unit (i.e., a single cover). The inner wall 810 and the outer wall 811 may be welded or attached together via any known mechanism that allows for the inner and outer walls 810 and 811 to form the single cover. The single cover may then be affixed, adhered, or otherwise mechanically connected to the base. The inner wall 810 and the outer wall 811 are spaced a distance 815 apart except for where they are attached to form the single cover 814. The inner wall 810 is mechanically attached to the base 812 and an enclosed volume 820 is defined therebetween.

The distance 815 defines a gap 816 (i.e., a volume of air) between the outer wall 811 and the inner wall 810. In an embodiment, the gap 816 may be a completely enclosed (and isolated) space. In some embodiments, the inner wall 810 and outer wall 811 may have a port 880 defined therein. The transducer 803 may be disposed over the port 880 and may be configured to sense the difference in pressure between the enclosed volume 820 and external environment. In some embodiments, the port 880 may be defined anywhere (e.g., the sides or the top) of the inner and outer walls 810 and 811. The microphone assembly 800 may also include a gasket 890 disposed on the external perimeter of the port 880. The gasket 890 couples the transducer 803 to the external environment. Additionally, the gasket 890 may ensure that the gap 816 is isolated from the enclosed volume 820 and the external environment. That is, the gasket 890 may be continuously connected around the perimeter of the port 880 opening of the inner wall 810 and around the port 880 opening of the outer wall 811 and be continuously connected between the inner and outer walls 810 and 811 (e.g., over the gap). In some embodiments, the gasket 890 may be made from rubber, plastic, ceramic, metal, or a combination thereof.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

We claim:

1. A microphone assembly, comprising:

a housing defining a port, wherein the housing comprises:

a base;

a cover coupled to the base, the cover comprising an inner wall and an outer wall encompassing the inner wall, a portion of the inner wall separated from a portion of the outer wall, wherein together the base and the inner wall define an enclosed volume; and an acoustic transducer disposed in the enclosed volume.

2. The microphone assembly of claim 1, wherein the outer wall comprises an opening providing fluid communication between an external environment of the microphone assembly and a volume between the inner wall and the outer wall.

3. The microphone assembly of claim 2, wherein the inner wall and the outer wall each comprise a cylindrical wall portion and a top portion, wherein the cylindrical wall portion of the inner wall is concentrically located within the cylindrical wall portion of the outer wall.

4. The microphone assembly of claim 2, wherein the opening is a circular opening on the cylindrical wall portion of the outer wall.

5. The microphone assembly of claim 4, wherein a diameter of the opening is large enough to vent frequencies up to at least 217 Hz.

6. The microphone assembly of claim 1, wherein the outer wall comprises a metal, and wherein the inner wall comprises one of a plastic material or a ceramic material.

7. The microphone assembly of claim 1, wherein the outer wall is electrically connected to the base, and wherein the inner wall is electrically insulated from the base.

8. The microphone assembly of claim 1, wherein both the outer wall and the inner wall are coupled to a first surface of the base.

9. The microphone assembly of claim 1, wherein a portion of the inner wall and a portion of the outer wall are coupled together.

10. The microphone assembly of claim 1, wherein the acoustic transducer further comprises:

a transducer substrate defining an aperture;

a diaphragm coupled to the transducer substrate and disposed over the aperture; and a perforated back plate coupled to the transducer substrate and spaced apart from the diaphragm.

11. A microphone assembly, comprising:

a housing defining a port, wherein the housing comprises:

a base;

a cover comprising an outer wall and an inner wall, each of the outer wall and the inner wall mechanically connected to the base, wherein the inner wall is spaced apart from the outer wall, and wherein together the base and the inner wall define an enclosed volume; and an acoustic transducer disposed in the enclosed volume.

12. The microphone assembly of claim 11, wherein the outer wall defines an opening.

13. The microphone assembly of claim 12, wherein the opening is located on a side of the outer wall.

14. The microphone assembly of claim 13, wherein the port is located in the base and the transducer is disposed above the port.

15. The microphone assembly of claim 12, wherein a diameter of the opening is large enough to vent frequencies up to at least 217 Hz.

16. The microphone assembly of claim 11, wherein the outer wall comprises a metal, and wherein the inner wall comprises one of a plastic material or a ceramic material.

17. The microphone assembly of claim 11, wherein the outer wall is electrically connected to the base, and wherein the inner wall is electrically insulated from the base.

18. The microphone assembly of claim 11, wherein both the outer wall and the inner wall are coupled to a first surface of the base.

19. The microphone assembly of claim 11, wherein the inner wall and the outer wall are cylindrically shaped, and wherein a diameter of the outer wall is greater than a diameter of the inner wall.

20. The microphone assembly of claim 11, wherein the acoustic transducer further comprises:

a transducer substrate defining an aperture;

a diaphragm coupled to the transducer substrate and disposed over the aperture; and a perforated back plate coupled to the transducer substrate and spaced apart from the diaphragm.

* * * * *